US007901519B2

(12) United States Patent
Cao

(10) Patent No.: US 7,901,519 B2
(45) Date of Patent: Mar. 8, 2011

(54) HIGH STRENGTH MARTENSITIC STAINLESS STEEL ALLOYS, METHODS OF FORMING THE SAME, AND ARTICLES FORMED THEREFROM

(75) Inventor: Wei-Di Cao, Charlotte, NC (US)

(73) Assignee: ATI Properties, Inc., Albany, OR (US)

( * ) Notice: Subject to any disclaimer, the term of this patent is extended or adjusted under 35 U.S.C. 154(b) by 0 days.

(21) Appl. No.: 10/732,571

(22) Filed: Dec. 10, 2003

(65) Prior Publication Data

US 2005/0126662 A1 Jun. 16, 2005

(51) Int. Cl.
*C22C 38/44* (2006.01)

(52) U.S. Cl. ..... 148/326; 148/327; 148/607; 420/49; 420/53

(58) Field of Classification Search ..... 148/326–327, 148/607; 420/49, 52–53, 67
See application file for complete search history.

(56) References Cited

U.S. PATENT DOCUMENTS

| | | | | |
|---|---|---|---|---|
| 3,347,663 | A | 10/1967 | Bieber | |
| 3,408,178 | A | 10/1968 | Myers et al. | |
| 3,556,776 | A | 1/1971 | Clarke, Jr. et al. | |
| 3,658,513 | A * | 4/1972 | Clarke, Jr. | 420/38 |
| 5,000,912 | A * | 3/1991 | Bendel et al. | 420/34 |
| 5,035,855 | A | 7/1991 | Utsunomiya et al. | |
| 5,512,237 | A | 4/1996 | Stigenberg | |
| 5,681,528 | A | 10/1997 | Martin et al. | |
| 5,855,844 | A | 1/1999 | Martin | |
| 5,888,449 | A | 3/1999 | Kennedy et al. | |
| RE36,382 | E | 11/1999 | Hultin-Stigenberg | |
| 5,976,282 | A | 11/1999 | Fukuda et al. | |
| 6,793,744 | B1 * | 9/2004 | Jung | 148/325 |
| 2004/0238079 | A1 * | 12/2004 | Kimura et al. | 148/592 |

FOREIGN PATENT DOCUMENTS

| | | | |
|---|---|---|---|
| FR | 2086805 A | | 12/1971 |
| JP | 350036649 | * | 2/1985 |
| JP | 360092457 | * | 5/1985 |
| JP | 02111844 A | * | 4/1990 |
| JP | 402310339 | * | 12/1990 |
| JP | 2002206147 A | * | 7/2002 |
| WO | WO 02/079534 A1 | | 10/2002 |

OTHER PUBLICATIONS

Potak, Ya. M., et al., "Structural diagram of low-carbon stainless steels applicable to metal that was cast and deposited during welding," (1972) Avtomaticheskaya Svarka 25(5), p. 10-13, (Abstract).*

(Continued)

*Primary Examiner* — Alexa D. Neckel
*Assistant Examiner* — Nicholas A. Smith
(74) *Attorney, Agent, or Firm* — K & L Gates LLP; Patrick J. Viccaro; John E. Grosselin, III

(57) ABSTRACT

A precipitation hardenable martensitic stainless steel that includes, in percent by weight, 11.0 to 12.5 percent chromium, 1.0 to 2.5 percent molybdenum, 0.15 to 0.5 percent titanium, 0.7 to 1.5 percent aluminum, 0.5 to 2.5 percent copper, 9.0 to 11.0 percent nickel, up to 0.02 percent carbon, up to 2.0 percent tungsten, and up to 0.001 percent boron. Articles formed from the stainless steel and methods of forming the same are also disclosed.

63 Claims, 5 Drawing Sheets

OTHER PUBLICATIONS

"A New High Strength Stainless Maraging Spring Steel with Isotropic Shaping Capability", Weber, Advanced Engineering Materials 2001, 3, No. 9, pp. 698-701.
"High strength stainless alloy resists stress corrosion cracking", Advanced Materials & Processes, Martin et al., Mar. 1998, pp. 37-39.
"Recent Developments in Precipitation Hardenable Stainless Steels", Perry, pp. 1-9 (as presented at the Golden Gate Welding and Metals Conference, Nov. 8, 1972).
"Marval X 12: A Stainless Maraging Steel Used in Aerospace Applications", The Minerals, Metals & Materials Society, 1988, Papier, pp. 125-155.
U.S. Appl. No. 12/180,743, filed Jul. 27, 2008 (36 pages).
Carpenter Technical Datasheet—Custom 465® Stainless, printed from http://cartech.ides.com/datasheet.aspx?&I=101&E=55 &FMT=PRINT on Oct. 24, 2008, 16 pages.
Technical Data Sheet: ATI S240® Alloy, ATI Allvac, Sep. 30, 2008, 4 pages.
Metal Suppliers Online, Properties of Stainless Steel 13-8 Plus Related Metals, printed from http://www.metalsuppliersonline.com/Research/Property/metals/1737.asp on Oct. 24, 2008, 3 pages.
Metal Suppliers Online, 15-5 Stainless Steel, printed from http://www.suppliersonline.com/propertypages/15-5.asp on Oct. 24, 2008, 4 pages.
Technical Data Sheet: ATI S240™ Alloy, ATI Allvac, Apr. 22, 2008, 4 pages.
Specification Sheet: 17-4PH (UNS S17400), Sandmeyer Steel Company, Jun. 2003, 2 pages.
Data Sheet for Alloy PH13-8MO, Brown-Pacific, Inc. 2001, printed from http://www.brownpacific.com/Product_Literature/ALLOY_PH13-8MO/alloy_ph13-8mo.html on Sep. 2, 2008, 2 pages.
Data Sheet for AMS 5659 (15-5PH), Corus Engineering Steels, Jun. 2003, 2 pages.
"Ultra-High-Strength Stainless Steel Resists Stress Corrosion Cracking," in article entitled "Innovations in Specialty Steels," Advanced Materials & Processes, Jan. 2004, pp. 26-35.
Guitterez, Anthony, "High-Strength Stainless Steels," Advanced Materials & Processes, Jun. 2006, 4 pages.
W.T. Geng et al., "Influence of alloying additions on grain boundary cohesion of transition metals: first-principle determination and its phenomenological extension," Physical Review B, vol. 63 (2001),165415.
ATI Allvac, ATI 13-8 Supertough® Alloy, Technical Data Sheet, Jun. 30, 2008.
Written Opinion of the International Searching Authority for International Application No. PCT/US2004/026702, European Patent Office (acting as International Searching Authority), 3 pp. (Aug. 4, 2005).
International Search Report for International Application No. PCT/US2004/026702, European Patent Office (acting as International Searching Authority), 7 pp. (Aug. 4, 2005).

* cited by examiner

HIGH STRENGTH MARTENSITIC STAINLESS STEEL ALLOYS, METHODS OF FORMING THE SAME, AND ARTICLES FORMED THEREFROM

TECHNICAL FIELD

The present invention relates to high strength martensitic stainless steel alloys, methods of forming the same, and articles formed therefrom.

BACKGROUND

Significant efforts have been made to formulate certain stainless steel alloys, such as martensitic precipitation hardening stainless steel alloys that exhibit superior properties for use in high performance articles. The potential for excellent strength-to-weight ratios, toughness, corrosion resistance, and stress corrosion cracking (SCC) resistance of articles formed from these alloys make them particularly well suited for use as aerospace structural components, such as flap tracks, actuators, engine mounts, and landing gear hardware. These properties, along with various manufacturing considerations, are strongly influenced by alloy composition, structure, heat treatment, and level of process control in the alloy systems. To obtain the properties necessary for high performance steel applications, careful and strict control of the alloying components, and the amounts and ratios of each, is generally required. Even slight adjustments in the alloying components or their amounts can significantly affect the properties and performance of these stainless steel alloys.

For example, early forms of martensitic stainless steel alloys employed copper as the major hardening element. These early forms of steel alloys are recognized as having good corrosion and SCC resistance, but have been found to have relatively low yield strength (YS<180 ksi). Because of the relatively inferior strength properties exhibited by martensitic stainless steel alloys employing copper, copper has not been favored as a major strengthening element in high strength stainless steel alloys.

Other martensitic stainless steel alloys have been developed that employ various amounts of aluminum as strengthening elements. These alloys can provide a yield strength greater than 200 ksi in the H950 condition (i.e., aged at an aging temperature of 950° F.) along with good ductility and toughness. However, the strength of this type of martensitic steel is still relatively low for many high strength applications. Other martensitic stainless steel alloys have been developed that employ both aluminum and copper as strengthening elements. These alloys exhibit much higher strengths (YS≧235 ksi), but fail to achieve acceptable levels of fracture toughness ($K_{1C}$<65 ksi·in$^{1/2}$).

Other approaches to forming martensitic stainless steel alloys involve the addition of titanium as the major strengthening element along with various amounts of copper, as the secondary strengthener, and proper nickel-chromium equivalents. These approaches provide relatively high strength (YS>240 ksi) and good corrosion resistance, but low toughness (Charpy V-notch (CVN)<10 ft/lb and $K_{1C}$<65 ksi·in$^{1/2}$). Other more recent developments include the addition of relatively high amounts of titanium (1.5%-1.8% by weight) and nickel that achieves high toughness, but at the possible expense of corrosion resistance and SCC resistance, due to the nickel/chromium imbalance. These latter alloying systems include a costly and time consuming cryogenic treatment step after solution heat treatment in order to achieve their high performance properties.

Still other high strength martensitic steel alloys employ a combination of aluminum and titanium as strengthening agents. These approaches can be divided into two groups: 1) alloys that employ relatively low amounts of aluminum and titanium and provide steels that exhibit relatively high toughness; and 2) alloys that employ relatively higher amounts of aluminum and titanium and provide steels that exhibit relatively high strength. However, it has been found that steel alloys that exhibit high strength generally exhibit low toughness, with Charpy impact energies being measured at only a few foot-pounds and facture toughness being less than 60 ksi·in$^{1/2}$ at room temperature.

Other approaches to providing high strength steel alloys employ the use of one or more of silicon, beryllium and molybdenum as hardening elements to form steel alloys that exhibit very high strength, but low toughness. Because of their low toughness properties, these steel alloys are unsuitable for high performance structural applications.

Accordingly, further improvements would be a welcome addition to the prior art processes, which appear to lack well-established alloy design principles to determine which precipitation hardening elements should be used, how to combine precipitation hardening elements with other components of the alloy, and how the matrix chemistry should be correspondingly adjusted, to improve the characteristics of the stainless steel alloys. In particular, there is a continued need for approaches to increase the strength and toughness of martensitic stainless steel to provide greater integrity and performance in the articles formed therefrom.

SUMMARY

The present invention provides precipitation hardenable martensitic stainless steels, articles formed therefrom, and methods of forming the same. In one embodiment, the martensitic stainless steel alloy includes, in percent by weight, 11.0 to 12.5 percent chromium, 1.0 to 2.5 percent molybdenum, 0.15 to 0.5 percent titanium, 0.7 to 1.5 percent aluminum, 0.5 to 2.5 percent copper, 9.0 to 11.0 percent nickel, up to 0.02 percent carbon, up to 2.0 percent tungsten, and up to 0.001% boron.

In another embodiment, the present invention provides a precipitation hardenable martensitic stainless steel, articles formed therefrom, and methods of forming the same, wherein the martensitic stainless steel alloy consists essentially of the components identified immediately above, iron, and incidental impurities.

In another embodiment, the present invention also provides a precipitation hardenable martensitic stainless steel, articles formed therefrom, and methods of forming the same, wherein the martensitic stainless steel alloy includes, in percent by weight, 11.0 to 12.0 percent chromium, 1.0 to 2.0 percent molybdenum, 0.15 to 0.3 percent titanium, 1.0 to 1.3 percent aluminum, 1.5 to 2.5 percent copper, 9.0 to 10.0 percent nickel, 0.008 to 0.012 percent carbon, up to 1.5 percent tungsten, and up to 0.001 percent boron.

In another embodiment, the present invention provides a precipitation hardenable martensitic stainless steel, articles formed therefrom, and methods of forming the same, wherein the martensitic stainless steel alloy consists essentially of the components identified immediately above, iron, and incidental impurities.

The present invention also provides a precipitation hardenable martensitic stainless steel, articles formed therefrom, and methods of forming the same, wherein the martensitic stainless steel alloy includes, in percent by weight, 11.0 to 12.0 percent chromium, 1.0 to 2.0 percent molybdenum, 0.3 to 0.5 percent titanium, 0.9 to 1.2 percent aluminum, 0.5 to 1.5 percent copper, 9.5 to 10.5 percent nickel, 0.01 to 0.016 percent carbon, up to 1.5 percent tungsten, and up to 0.001 percent boron.

In another embodiment, the present invention provides a precipitation hardenable martensitic stainless steel, articles formed therefrom, and methods of forming the same, wherein the martensitic stainless steel consists essentially of the components identified immediately above, iron, and incidental impurities.

It should be understood that this invention is not limited to the embodiments disclosed in this Summary, and is intended to cover modifications that are within the spirit and scope of the invention, as defined, for example, by the appended claims.

DETAILED DESCRIPTION OF EMBODIMENTS OF THE INVENTION

Figure 1:
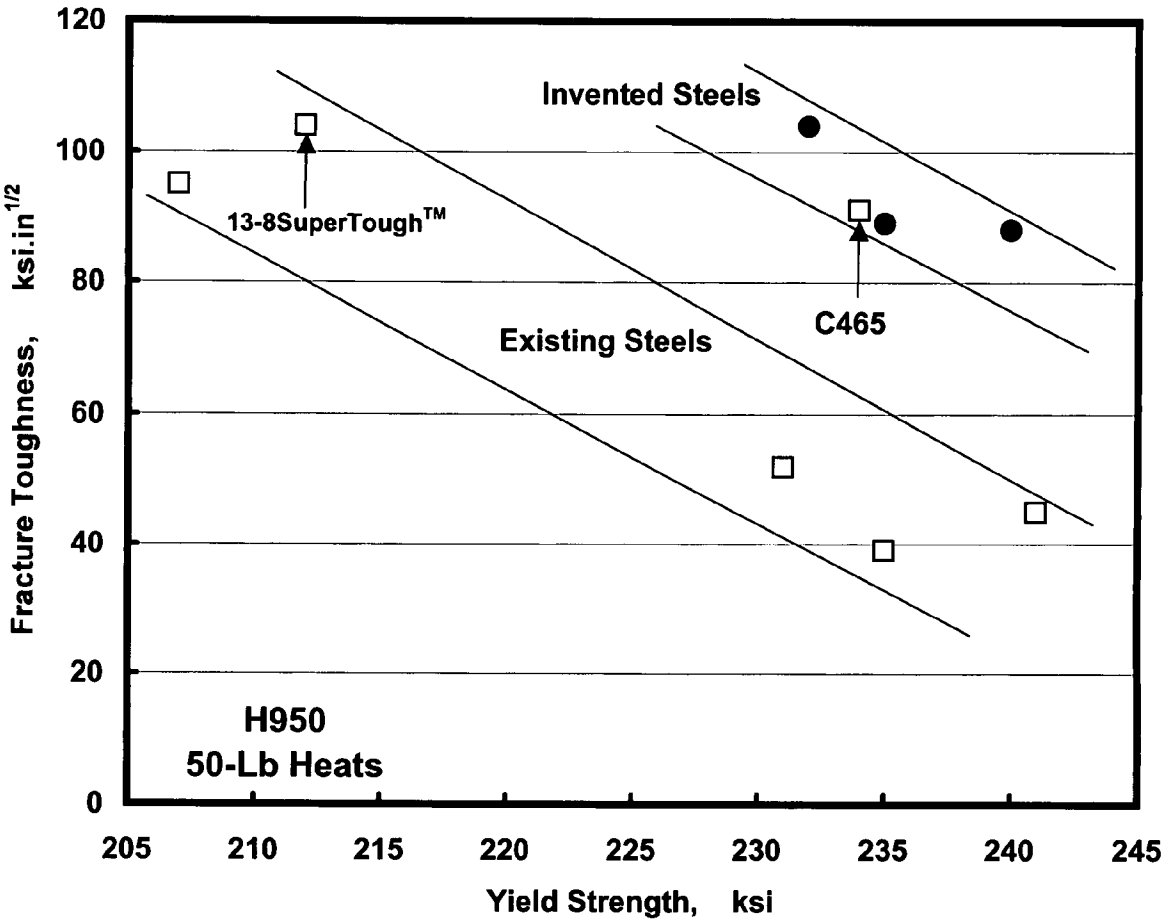
FIG. 1 graphically illustrates fracture toughness in certain steels produced in 50-lb heats as a function of yield strength at H950 condition.

It is to be understood that certain descriptions of the present invention have been simplified to illustrate only those elements and limitations that are relevant to a clear understanding of the present invention, while eliminating, for purposes of clarity, other elements. Those of ordinary skill in the art, upon considering the present description of the invention, will recognize that other elements and/or limitations may be desirable in order to implement the present invention. However, because such other elements and/or limitations may be readily ascertained by one of ordinary skill upon considering the present description of the invention, and are not necessary for a complete understanding of the present invention, a discussion of such elements and limitations is not provided herein. For example, as discussed herein, certain embodiments of the stainless steel alloys of the present invention may be used in, for example, high performance structural components, such as aerospace applications, for example, flap tracks, actuators, engine mounts, and landing gear hardware. The manner of manufacturing high performance structural components is generally understood by those of ordinary skill in the art and, accordingly, is not described in detail herein.

Furthermore, certain compositions within the present invention will be generally described in the form of stainless steel alloys that may be used to produce certain high performance components and articles, such as aerospace components. It will be understood, however, that the present invention may be embodied in forms and applied to end uses that are not specifically and expressly described herein. For example, one skilled in the art will appreciate that embodiments of the present invention may be incorporated into other high performance articles. Non-limiting examples of such other high performance articles include weapons materials, such as handgun barrels, vehicle parts, and other high strength stainless steel applications.

Other than in the examples herein, or unless otherwise expressly specified, all of the numerical ranges, amounts, values and percentages, such as those for amounts of materials, elemental contents, times and temperatures of reaction, ratios of amounts, and others, in the following portion of the specification and attached claims may be read as if prefaced by the word "about" even though the term "about" may not expressly appear with the value, amount, or range. Accordingly, unless indicated to the contrary, the numerical parameters set forth in the following specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contains error necessarily resulting from the standard deviation found in its underlying respective testing measurements. Furthermore, when numerical ranges are set forth herein, these ranges are inclusive of the recited range end points (i.e., end points may be used). When percentages by weight are used herein, the numerical values reported are relative to the total alloy weight.

Also, it should be understood that any numerical range recited herein is intended to include all sub-ranges subsumed therein. For example, a range of "1 to 10" is intended to include all sub-ranges between and including the recited minimum value of 1 and the recited maximum value of 10, that is, having a minimum value equal to or greater than 1 and a maximum value of equal to or less than 10.

The present invention is directed, generally, to stainless steel materials, and more particularly, to high strength martensitic stainless steel alloys, such as precipitation hardenable martensitic stainless steel alloys, methods of forming the same, and articles formed therefrom. Embodiments of the stainless steel alloys of the present invention have been found to have application in high performance articles, such as aerospace components. It has been found that the combination of aluminum, titanium, and copper as hardening elements when combined with other alloying agents in high strength stainless steel alloys in the amounts set forth herein provide significant advancement in certain properties over known high strength stainless steel alloys. In certain embodiments, the combination of alloying agents of the high strength martensitic stainless steels of the present invention provide excellent toughness and high strength properties, excellent corrosion/SCC resistance, and excellent response to processing, such as heat treatment, without employing time consuming and costly cryogenic treatment.

It has been found that the performance advantages of the present invention may be obtained by the combination of aluminum, copper, and titanium at controlled amounts as hardening elements, together with carefully adjusted matrix chemistry, especially relating to amounts of chromium, molybdenum, nickel, and, optionally, tungsten, boron, and carbon.

The amount of aluminum present in the alloys of the present invention may range from 0.7 to 1.5 percent by weight, in certain embodiments may be in amounts ranging from 1.0 to 1.3 percent by weight, and in other embodiments may be in amounts ranging from 0.9 to 1.2 percent by weight. The amount of titanium may range from 0.15 to 0.5 percent by weight, in certain embodiments may be in amounts ranging from 0.15 to 0.3 percent by weight, and in other embodiments may be in amounts ranging from 0.3 to 0.5 percent by weight. The amount of copper may range from 0.5 to 2.5 percent by weight, in certain embodiments may be in amounts ranging from 1.5 to 2.5 percent by weight, and in other embodiments may be in amounts ranging from 0.5 to 1.5 percent by weight. The chromium content may range from 11.0 to 12.5 percent by weight, and in certain embodiments may be in amounts ranging from 11.0 to 12.0 percent by weight. The molybdenum content may range from 1.0 to 2.5 percent by weight, and in certain embodiments may be in amounts ranging from 1.0 to 2.0 percent by weight. The nickel content may range from 9.0 to 11.0 percent by weight, in certain embodiments may be in amounts ranging from 9.0 to 10.0 percent by weight, and in other embodiments may be in amounts ranging from 9.5 to 10.5 percent by weight. The boron content may range up to 0.001 percent by weight. The tungsten content may range up to 2.0 percent by weight, and in certain embodiments may be in amounts ranging from 0.5 to 1.5 percent by weight. The amount of carbon may range from 0.005 to 0.02 percent by weight, in certain embodiments may be in amounts ranging from 0.008 to 0.012 percent by weight, and in other embodiments may be in amounts ranging from 0.01 to 0.016 percent by weight.

Within the broad ranges set forth above, and in another embodiment of the present invention, the aluminum content may range from 1.0 to 1.3 percent by weight, the copper content may range from 1.5 to 2.5 percent by weight, the titanium content may range from 0.15 to 0.3 percent by weight, the chromium content may range from 11.0 to 12.0 percent by weight, the molybdenum content may range from 1.0 to 2.0 percent by weight, the nickel content may range from 9.0 to 10.0 percent by weight, the tungsten content may range from 0.5 to 1.5 percent by weight, the boron content may range up to 0.001 percent by weight, and the carbon content may range from 0.008 to 0.012 percent by weight.

In another embodiment of the present invention, the aluminum content may range from 0.9 to 1.2 percent by weight, the copper content may range from 0.5 to 1.5 percent by weight, the titanium content may range from 0.3 to 0.5 percent by weight, the chromium content may range from 11.0 to 12.0 percent by weight, the molybdenum content may range from 1.0 to 2.0 percent by weight, the nickel content may range from 9.5 to 10.5 percent by weight, the tungsten content may range from 0.5 to 1.5 percent by weight, the boron content may range up to 0.001 percent by weight, and the carbon content may range from 0.01 to 0.016 percent by weight.

As set forth in more detail below, it has been found that martensitic stainless steel alloys of the present invention may be formulated to exhibit a superior combination of high performance stainless steel properties from a balance of alloying agents within the ranges set forth above. Alloy design methodology and principle have been established to determine advantageous combinations of all three hardening elements aluminum, titanium, and copper that exhibit particularly good mechanical and chemical properties, response to heat treatments, and corrosion and SCC resistances.

In particular, it has been found that a balance between aluminum and titanium provides high strength performance advantages in embodiments of the present invention when combined with the other alloying agents. Although both aluminum and titanium may increase strength and reduce toughness of high strength martensitic stainless steels, their influences have been found to be of varying degrees. Aluminum and titanium affect the response of steels to heat treatment by altering the aging behavior and the temperature at which martensitic transformation begins (Ms). Aluminum and titanium may also affect corrosion and SCC behaviors differently.

In addition, the presence of copper with aluminum and titanium within the ranges set forth herein provide additional benefits to the embodiments of the high strength martensitic steel alloys of the present invention. Although certain prior art teachings are said to avoid the use of copper in high strength martensitic stainless steels because of the relatively inferior strength properties that copper imparts to the stainless steel alloys, it has been found that the addition of copper to embodiments of the present invention in amounts as set forth herein improves not only the strength but also the toughness of steel alloys. Also, the corrosion and SCC resistance of certain embodiments of the present invention may be enhanced by copper addition. Accordingly, embodiments of the present invention exhibit excellent strength and toughness, corrosion/SCC resistance and favorable heat treatment response as a result of the additions of copper, aluminum, and titanium as set forth herein.

Accordingly, as described in detail below, the matrix chemistry of the present invention provides a careful balance of carbon, boron, nickel, chromium, molybdenum, and tungsten with the three hardening elements aluminum, titanium, and copper, in unique combinations, to positively effect toughness, corrosion/SCC resistance and response to heat treatment of the martensitic steel alloys while maintaining high strength properties.

Effects of Aluminum, Titanium and Copper

Aluminum, titanium, and copper, both individually and in combination as precipitation hardening elements, have been found to positively effect the properties of high strength martensitic stainless steels when combined with the other major matrix alloying elements in the amounts set forth herein. As a result, alloy design principles have been developed based on certain test steels that determine the advantageous combinations of precipitation hardening elements and their favorable matrix chemistry.

The test steels were prepared from alloys made as 50-lb vacuum induction melting/vacuum arc re-melting (VIM/VAR) heats and cast as 4¾ inch ingots. The ingots were subject to homogenization and forged to 1 inch×3 inch cross sectional slabs. Sample blanks were cut from forged slabs, solution-treated at 1700° F. for 1 hour and air-cooled to room temperature. The solution-treated blanks were subjected to aging treatment for four hours at various temperatures, such as 950° F. (H950) and 1000° F. (H1000). Tensile tests were performed as outlined by ASTM E8 and Charpy impact tests were performed as outlined by ASTM E23. Fracture toughness of test steels was evaluated by three-point bend test of subsized pre-cracked samples, as known in the art. $K_{1J}$ was calculated as an indicator of $K_{1C}$ per the J-integral concept.

Using the experimental procedures set forth above for all test steels, and measuring the $M_S$ temperature of test steels by dilatometric tests, the aluminum, titanium, and copper alloying elements were found to effect properties such as strength, toughness, and response to heat treatments, as set forth below.

In particular, alloys of varied aluminum, titanium and copper contents, as hardening elements, were found to effect the high strength properties of stainless steels that employed a base chemistry that included 0.005 percent carbon, 12.0 percent chromium, 9.0 percent nickel and 1.5 percent molybdenum. With adjustments being made only to the amounts of the precipitation hardening strengtheners, aluminum, titanium, and copper, it was found that aluminum content in the alloys of the present invention should range from 0.7 to 1.5 percent by weight, in certain embodiments may be in amounts ranging from 1.0 to 1.3 percent by weight, and in other embodiments may be in amounts ranging from 0.9 to 1.2 percent by weight; the titanium content in the alloys of the present invention should range from 0.15 to 0.5 percent by weight, in certain embodiments may be in amounts ranging from 0.15 to 0.3 percent by weight, and in other embodiments may be in amounts ranging from 0.3 to 0.5 percent by weight; and the copper content in the alloys of the present invention should range from 0.5 to 2.5 percent by weight, in certain embodiments may be in amounts ranging from 1.5 to 2.5 percent by total weight, and in other embodiments may be in amounts ranging from 0.5 to 1.5 percent by weight.

A. Strength

Tests at several aging conditions revealed that amounts of aluminum, titanium, and copper, as strengthening agents, have different effects on the strength of the stainless steel alloys.

Test results indicate that titanium has a strong strengthening effect, while copper has a very weak effect. When yield strength of test steels are plotted as a function of weight percent of aluminum, titanium and copper, titanium and aluminum are found to have similar strengthening effect in terms of weight percentage. Regression equations quantitatively relate the effect of each element on yield strength, as follows:

$$(YS)_{Al}(\text{ksi})=114+122\ (\%\ \text{Al})-34\ (\%\ \text{Al})^2$$

$$(YS)_{Ti}(\text{ksi})=115+120\ (\%\ \text{Ti})-20\ (\%\ \text{Ti})^2$$

$$(YS)_{Cu}(\text{ksi})=112+12\ (\%\ \text{Cu})$$

Due to the interaction between strengthening agents, the resultant strengthening effect from multiple agents are found to be less than the sum of strengthening effect of each individual agent. Because there is no accurate theoretical model to evaluate the interaction between strengthening agents, this interaction may be evaluated by a series of test steels with the addition of multiple strengthening agents.

The combination of strengthening behavior of aluminum, titanium, and copper in the precipitation hardened condition can be calculated and described by linear regression equations as follows:

For H950 Condition:

$$YS\ (\text{ksi})=194.4+20.9\ (\%\ \text{Al})+22.7\ (\%\ \text{Ti})+6.8\ (\%\ \text{Cu})$$
$$R^2=0.77$$

For H1000 Condition:

$$YS\ (\text{ksi})=173.5+25.8\ (\%\ \text{Al})+33.2\ (\%\ \text{Ti})+7.5\ (\%\ \text{Cu})$$
$$R^2=0.90$$

Because of the numerous combinations of aluminum, titanium, and copper that could meet a specific strength goal set forth above, the desired combinations and amounts of aluminum, titanium, and copper may be determined based on the restrictions from other requirements, set forth below.

B. Toughness

Single element addition reveals that both Charpy impact toughness and fracture toughness of steels decrease with increasing precipitation hardener content at equivalent strength levels. In particular, the presence and amounts of aluminum and titanium appear to effect toughness properties. At equivalent strength levels, aluminum provides higher Charpy impact toughness, but titanium provides higher fracture toughness, especially at higher titanium content. When toughness is plotted as a function of yield strength, at lower strength (YS<200 ksi) aluminum is found to provide both higher Charpy impact energy and higher fracture toughness. Titanium may be particularly effective when strength is high (YS>200 ksi). In addition, it was found that copper provides a unique effect on fracture toughness, wherein the test steels that include copper exhibit an increase in strength and no reduction in fracture toughness.

Tests that determine the effect of adding multiple precipitation hardening elements on toughness reveal that there is apparently no detrimental effect on toughness from adding aluminum and titanium in combination. Generally, test steels with relatively high aluminum addition show higher Charpy impact toughness at equivalent strength and limited fracture toughness. Tests further show that steels with relatively high amounts of titanium exhibit higher fracture toughness. This trend is consistent with that of single element addition.

Tests that determine the effect of copper addition on strength and toughness of steels relative to various aluminum and titanium contents show that adding copper to high strength martensitic stainless steels improves both strength and toughness. Considering the positive effect of copper on corrosion/SCC resistance of martensitic stainless steels, copper is found to provide improved strength, toughness, and improved corrosion/SCC resistance to embodiments of the present invention.

Among the three major strengthening elements copper, aluminum and titanium, it has been found that titanium had the most detrimental effect on corrosion resistance of steel.

C. Response to Heat Treatments

Due to the potentially high cost associated with alloy processing, the response of steels to heat treatment is an important consideration in forming finished components from martensitic stainless steel alloys. The effect of alloying elements on martensitic start ($M_S$) temperature also has fundamental significance in martensitic steels.

The martensitic stainless steels of the present invention can be readily transformed to predominantly martensitic state by cooling to ambient temperature after solution treatment if the Ms temperature is greater than 100° C. Under these conditions, cryogenic treatment is not necessary in forming steel alloys of the present invention, thereby reducing production cost and cycle time relative to other known martensitic stainless steels. Because the martensitic structure may not be obtained if $M_S$ temperature is too low (<65° C.), experiments using a variety of test steels may be employed to determine the effect of aluminum, titanium, and copper on $M_S$ temperature. The empirical equations, set forth below, describe the effect of each individual hardening element on $M_S$ temperature, while holding the other alloying elements constant at a base chemistry of 0.006 percent by weight carbon, 12.0 percent by weight chromium, 9.0 percent by weight nickel, and 1.5 percent by weight molybdenum. The empirical equations formulated from the tests results are as follows:

$$\text{For Al, } M_S\ (^\circ\ \text{C.})=184-3.75\ (\%\ \text{Al})$$

$$\text{For Ti, } M_S\ (^\circ\ \text{C.})=189-34.3\ (\%\ \text{Ti})$$

$$\text{For Cu, } M_S\ (^\circ\ \text{C.})=189-19.5\ (\%\ \text{Cu})$$

As illustrated in the above equations, amounts of titanium and copper may significantly reduce $M_S$ temperature of the alloy to which they are added, while aluminum has a relatively minor effect on $M_S$ temperature. Incorporating these equations into the overall matrix chemistry, the $M_S$ temperature of the tested steel alloys may be determined by the following expression:

$$M_S\,(^\circ\,C.)=195-1200\,(\%\,C-0.006)-23\,(\%\,Cr-12)-40\,(\%\,Ni-9)-16\,(\%\,(Mo+1/2W)-1.5)-3.75\,(\%\,Al)-34\,(\%\,Ti)-20\,(\%\,Cu)$$

Effective amounts of alloying elements, both precipitation hardeners and matrix elements as set forth herein, should be added such that the $M_S$ temperature of the steel is greater than 100° C. to eliminate cryogenic treatment, or slightly lower than 100° C. for use of subzero treatment to further improve properties.

The response of steel to aging treatment is another important consideration to high strength stainless steel formation. It has been found that relatively high aging temperature may be beneficial to other steel alloy properties, such as, for example, toughness and corrosion/SCC resistance, and may significantly increase the resistance to catastrophic failure of steel at similar strength levels. Ideally, steel alloys should not be sensitive to variations in aging temperature so that their properties can be nearly constant and maintained at a wide range of aging temperatures, such that high strength can be achieved at higher aging temperature where higher toughness can be obtained.

Aging peak temperature has been found to increase with increasing aluminum and titanium contents, and aluminum-strengthed steels have higher peak temperature where the aging peak temperature is plotted as a function of aluminum and titanium contents. Accordingly, alloys employing aluminum have a greater ability to maintain high strength at higher aging temperature relative to titanium and copper. Also, there are two aging peaks in copper-strengthening steels, and the peak temperature is nearly independent of copper contents.

Due, in part, to the different aging behaviors of aluminum, titanium, and copper, all three strengthening elements are employed in alloys of the present invention such that the aging response is less sensitive to aging temperature, and a flatter peak aging curve can be obtained. Steel alloys that include relatively high amounts of aluminum and low amounts of titanium, when added together with copper, as provided by embodiments of the present invention, form steels that exhibit very high strength at aging temperatures. For example, and as set forth below, certain embodiments of the present invention exhibit very high strength properties at an aging temperature of 1000° F. (i.e., H1000) that are equivalent to the strength achieved in prior art steels at lower aging temperatures around 950° F. (H950).

Effects of Remaining Alloying Agents in Steel Matrix

In addition to the significant effects that aluminum, titanium, and copper are found to have on toughness, corrosion/SCC resistance, and behavior to heat treatment of martensitic stainless steel alloys, the remaining alloying agents (i.e., carbon, chromium, nickel, molybdenum, tungsten, and boron), when combined with aluminum, titanium, and copper, also effect the properties of the steel alloys of the present invention when combined in the amounts as set forth herein.

Carbon in low, but effective, amounts is particularly advantageous for providing improved toughness in embodiments of the present invention. High carbon content may lead to lower strength, likely due to its effect on Ms temperature. In high titanium-containing steels, high levels of carbon may promote the formation of coarse carbide or carbo-nitride particles that significantly reduce toughness. Additions of carbon, as provided herein, enhance grain boundary cohesion that is beneficial to toughness and hydrogen SCC resistance. In certain embodiments of the present invention, and according to experimental and thermodynamic modelling results, excellent mechanical properties are obtained in steel alloys of the present invention when the carbon content ranges from 0.005 to 0.02 percent by weight, more narrowly ranges from 0.008 to 0.012 percent by weight, and in other embodiments ranges from 0.01 to 0.016 percent by weight, depending on the titanium content.

Chromium improves the corrosion/SCC resistance of steel alloys of the present invention. Chromium does not appear to have any significant effect on strength, but may reduce the toughness of the steel alloys of the present invention. Therefore, the amount of chromium should be in amounts that are high enough to effectively provide sufficient corrosion/SCC resistance to the steel, but at a level low enough to permit the addition of other elements that may positively effect or increase other performance characteristics, such as toughness. In embodiments of the present invention, chromium content should range from 11.0 to 12.5 percent by weight, and in certain embodiments of the present invention may more narrowly range from 11.0 to 12.0 percent by weight.

Nickel is one of the major elements for improving the toughness of high strength martensitic stainless steel. Although it is generally desirable to include nickel in high strength steel alloys at the highest possible levels, it has been found that in embodiments of the present invention, several conditions exist that may encourage limiting the nickel addition to relatively lower levels. For example, nickel may significantly reduce $M_S$ temperature, and at high levels, may inhibit the ability of the steel alloy to transfer to a martensitic state, which dramatically reduces achievable strength. Nickel may significantly improve the toughness of steels without reducing strength if nickel addition does not suppress $M_S$ temperature to below 100° C., but may reduce the strength of steel alloys if the $M_S$ temperature is already close to its lower limit. In embodiments of the present invention, nickel content should be present in amounts that are relative to the chromium content to guarantee excellent corrosion resistance. In embodiments of the present invention, it has been found that when chromium is present in amounts as set forth above, nickel content should range from 9.0 to 11.0 percent by weight, in certain embodiments may more narrowly range from of 9.0 to 10.0 percent by weight, and in other embodiments may range from 9.5 to 10.5 percent by weight. The maximum level of nickel addition may be determined on the basis of the balance of all requirements.

Molybdenum has been found to improve the corrosion resistance of steel alloys, and in certain amounts, may also improve its strength, ductility, and toughness properties. Excess additions of molybdenum may adversely affect strength or toughness. An increase in molybdenum content does not appear to reduce alloy strength, but may increase toughness of steel alloys, as long as the molybdenum levels do not suppress $M_S$ temperature below its lower limit. It is also anticipated that the corrosion resistance of steels may be improved by increased molybdenum contents. In certain embodiments of the present invention, the molybdenum content may range from 1.0 to 2.5 percent by weight, and may more narrowly range from 1.0 to 2.0 percent by weight. Within these ranges, it was found that in order to maintain corrosion resistance at levels suitable for high strength martensitic steel alloys, a minimum of 1.5 percent by weight molybdenum may be necessary.

Increasing grain boundary cohesion is important for hydrogen resistance of high strength martensitic steel alloys, and several alloying elements such as molybdenum, tungsten, carbon, and boron are effective in enhancing grain boundary cohesion. Tests have shown that boron and tungsten may be added to improve SCC resistance that is controlled by hydrogen resistance of steel alloys. In certain embodiments of the present invention, the amount of boron may range from up to 0.001 percent by weight. Tungsten may range from up to 2.0 percent by weight, and may more narrowly range from up to 1.5 percent by weight.

According to the test results and design principles stated above, an ultra-high strength martensitic precipitation hardening stainless steel may be formed that can exhibit YS≧220 ksi, $K_{1C}$≧70 ksi·in$^{1/2}$ and $K_{1SCC}$≧50 ksi·in$^{1/2}$.

To ensure the yield strength of the alloy is greater than or equal to 220 ksi, the following alloy design equation was developed based on the test results set forth herein:

$$194.4+20.9\ (\%\ Al)+22.7\ (\%\ Ti)+6.8\ (\%\ Cu)>220\ (ksi)$$

To confirm that the stainless steel alloy is a predominantly martensitic steel structure, the following equation was prepared from the testing set forth herein:

$$1200\ (\%\ C-0.006)+23\ (\%\ Cr-12)+40\ (\%\ Ni-9)+16(\%\ (Mo+1/2W)-1.5)+3.75\ (\%\ Al)+34\ (\%\ Ti)+20\ (\%\ Cu)\leqq 100\ (^\circ\ C.)$$

The equations set forth above provide alloy design principles that assist in determining which precipitation hardening elements should be used and how to combine precipitation hardening elements with other components of the alloy to achieve superior performance properties such as strength, toughness, and corrosion/SCC resistance.

The present invention may be further understood by reference to the following examples. The following examples are merely illustrative of the invention and are not intended to be limiting. Unless otherwise indicated, all chemistries are by weight percent.

EXAMPLES

Example 1

A number of steels alloys of the present invention were made as 50-Lb VIM/VAR heats. Four inch round VAR ingots forged to 1 inch×3 inch plates at 1900° F. (1038° C.) and sample blanks were cut from forged plates for mechanical tests and microstructural study. Mechanical blanks were solution-treated at 1700° F. (927° C.) for one hour and then air cooled to room temperature. Following cooling, the blanks were reheated to aging temperature, air cooled to room temperature, and aged for four hours at designated temperatures (H950 and H1000). The chemistries of test steel alloys of the present invention are listed in Table 1, and identified as Heats 1-3.

By way of comparison, one heat of each of commercially available high strength martensitic steel alloys 13-8 Super-Tough™ (identified as 13-8ST), Marvel X-12, Vasco 734, XPH12-9, Custom 455® (identified as C455), and Custom 465® (identified as C465) were made and tested. The chemistries of these heats are also listed in Table 1.

TABLE 1

Chemistry of 50-Lbs Heats of Selected Steels of the Present Invention Relative to Commercially Available Steel Alloys

| | CHEMISTRY (wt. %) | | | | | | | | | | | | | |
|---|---|---|---|---|---|---|---|---|---|---|---|---|---|---|
| STEEL | C | Ni | Cr | Co | Mo | Nb | Ti | Al | Cu | Mn | Si | S* | P | N* |
| 1 | 0.014 | 9.05 | 11.94 | 0.01 | 1.99 | 0.02 | 0.176 | 1.13 | 1.96 | <0.01 | <0.01 | <3 | 0.004 | 4 |
| 2 | 0.007 | 9.98 | 11.45 | <0.01 | 1.49 | 0.02 | 0.40 | 1.13 | 0.98 | <0.01 | <0.01 | 3 | 0.003 | 25 |
| 3 | 0.015 | 8.99 | 11.97 | <0.01 | 1.51 | 0.02 | 0.49 | 0.76 | 0.99 | <0.01 | <0.01 | 3 | 0.003 | 12 |
| WA06 (13-8ST)[a] | 0.034 | 8.31 | 12.47 | 0.01 | 2.20 | 0.01 | 0.01 | 1.03 | 0.03 | <0.01 | <0.01 | 6 | 0.003 | 9 |
| WD30 (MarX12)[b] | 0.012 | 9.02 | 11.92 | 0.02 | 2.01 | <0.01 | 0.31 | 0.70 | <0.01 | <0.01 | <0.01 | 6 | 0.003 | 8 |
| WD29 (Vasco734)[c] | 0.006 | 10.50 | 11.71 | 0.02 | 0.09 | 0.03 | 0.38 | 1.25 | 0.04 | <0.01 | <0.01 | 5 | 0.007 | 6 |
| WG77 (XPH12-9)[d] | 0.04 | 8.70 | 11.75 | <0.01 | 1.52 | 0.12 | <0.01 | 1.61 | 1.19 | <0.01 | <0.01 | 3 | 0.003 | 8 |
| WD31 (C455)[e] | 0.006 | 8.41 | 11.61 | 0.02 | 0.28 | 0.30 | 1.15 | <0.01 | 2.09 | 0.01 | 0.01 | 10 | 0.006 | 8 |
| WG78 (C465)[f] | 0.005 | 10.97 | 11.73 | <0.01 | 1.01 | 0.04 | 1.57 | <0.01 | <0.01 | <0.01 | <0.01 | 4 | 0.003 | 17 |

[a]Commercially available from Allvac, an Allegheny Technologies Company, Monroe, NC
[b]Commercially available from Aubert & Duval in France
[c]Commercially available from Allvac, an Allegheny Technologies Company, Monroe, NC
[d]Commercially available from Armco (Now, AK Steel, Middletown, OH)
[e]Commercially available from Carpenter Technology Corporation, Reading, PA
[f]Commercially available from Carpenter Technology Corporation, Reading PA
*The amounts of S and N are in ppm The strength and toughness of all test steels at H950 condition were tested. The results of these tests are set forth in Table 2. As shown, test results indicate that the yield strength of embodiments of the steels alloys of the present invention is higher than those of some representative steels alloys tested, such as 13-8ST and Marvel X-12, and is equivalent to representative samples of Vasco734, XPH12-9, C455, and C465. Test results also indicated that steel alloys of the present invention exhibited improved Charpy impact and fracture toughness properties relative to most commercially available high strength martensitic stainless steels tested. The fracture toughness exhibited by embodiments of the present invention at H950 condition are equivalent to those of C465. As discussed herein, unlike C465, which requires cryogenic treatment after solution to achieve high performance properties, embodiments of the present invention may be formed by simple, non-cryogenic, heat treatment. The yield strength and fracture toughness of all tested steels are plotted in FIG. 1. As illustrated, embodiments of the steel alloys of the present invention exhibit an improved combination of yield strength and toughness relative to most commercially available steel alloys.

TABLE 2

Mechanical Properties of Test Steels at H950 Condition

| | | Tensile Properties | | | | Impact | |
|---|---|---|---|---|---|---|---|
| Alloy | H.T. | YS ksi | UTS ksi | EL % | RA % | Energy Ft-lbs | $K_{1J}$ ksi · in$^{1/2}$ |
| 1 | H950 | 232 | 244 | 12.7 | 51.2 | 20 | 104 |
| 2 | H950 | 240 | 252 | 15.1 | 56.1 | 15 | 88 |
| 3 | H950 | 235 | 245 | 14.2 | 61.3 | 22 | 89 |
| WA06 (13-8ST) | H950 | 212 | 227 | 15.9 | 63.3 | 53 | 104 |
| WD30 (Mar X-12) | H950 | 207 | 216 | 16.9 | 67.6 | 22 | 95 |
| WD29 (Vasco734) | H950 | 231 | 242 | 13.1 | 47.3 | 3.5 | 52 |
| WG77 (XPH12-9) | H950 | 235 | 263 | 7.0 | 10.8 | 5.5 | 39 |
| WD31 (C455) | H950 | 241 | 250 | 12.0 | 42.0 | 2.5 | 45 |
| WG78 (C465) | H950* | 234 | 250 | 15.9 | 58.5 | 11 | 91 |

*Cryogenic treatment in liquid nitrogen for 4 hrs after solution treatment.

Figure 2:
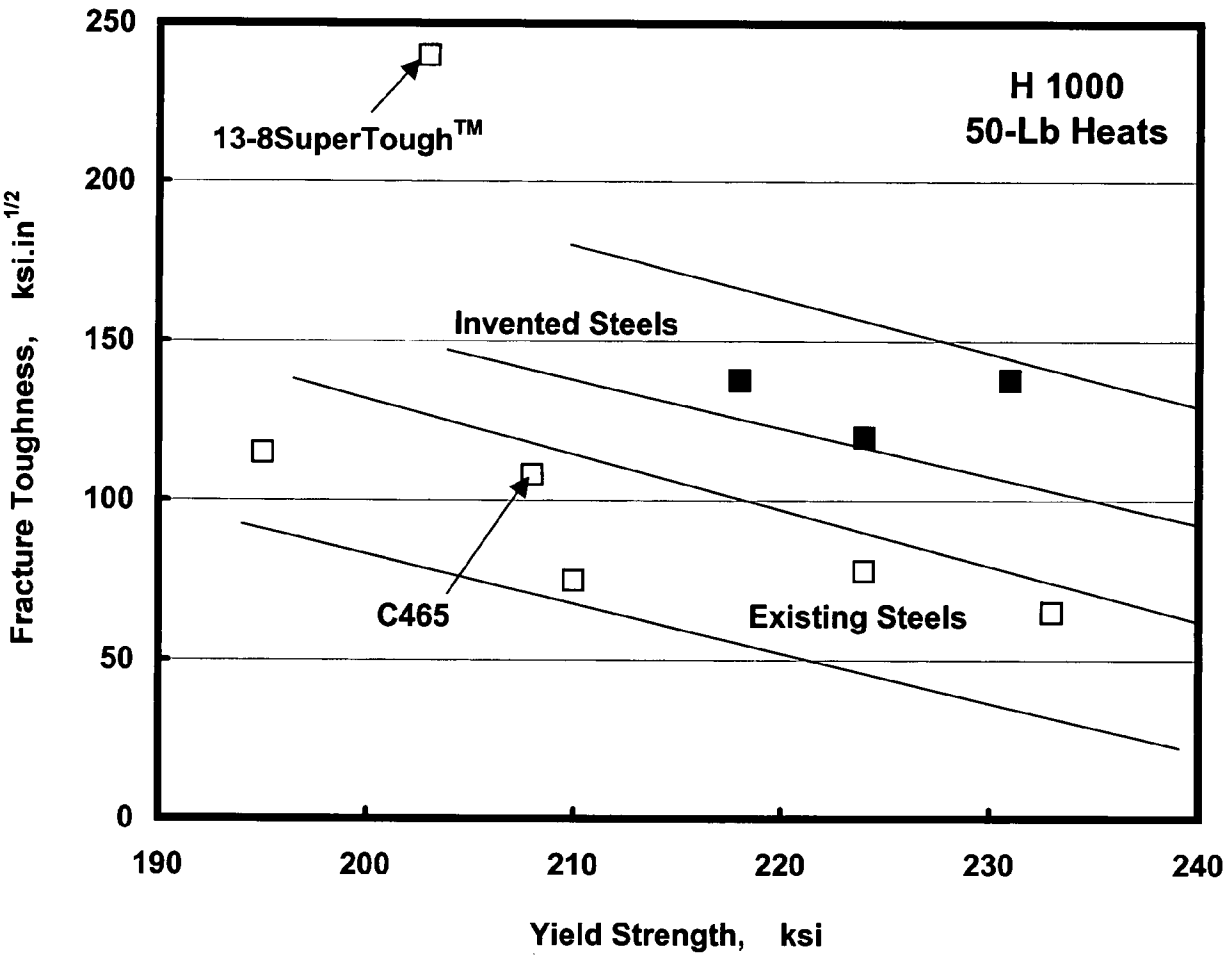
FIG. 2 graphically illustrates fracture toughness in certain steels produced in 50-lb heats as a function of yield strength at H1000 condition.

As shown in Table 3, test results indicated that the steel alloys of the present invention exhibit exceptional yield strength and fracture toughness at H1000 condition. The Vasco734 and XPH12-9 steel alloys exhibit similar yield strength properties as some embodiments of the present invention, but exhibit much lower fracture toughness. The representative sample of C465 steel alloy exhibited similar fracture toughness but lower yield strength relative to the alloys of the present invention. 13-8ST steel alloys exhibited extraordinary toughness, but relatively low strength relative to embodiments of the present invention. FIG. 2 graphically illustrates the fracture toughness as a function of yield strength in the tested 50-lb heats at H1000 condition.

TABLE 3

Mechanical Properties of Selected Steels at H1000 Condition

| | | Tensile Properties | | | | Impact | |
|---|---|---|---|---|---|---|---|
| Alloy | H.T. | YS ksi | UTS ksi | EL % | RA % | Energy ft-lbs | $K_{1J}$ ksi · in$^{1/2}$ |
| 1 | H1000 | 218 | 227 | 15.5 | 64.1 | 58 | 138 |
| 2 | H1000 | 231 | 240 | 14.9 | 60.6 | 23 | 140 |
| 3 | H1000 | 218 | 225 | 16.8 | 68.1 | 35 | 120 |
| WA06 (13-8ST) | H1000 | 203 | 213 | 16.9 | 67.8 | 122 | 240 |
| WD30 (Mar X-12) | H1000 | 195 | 203 | 18.0 | 72.5 | 65 | 115 |
| WD29 (Vasco734) | H1000 | 224 | 232 | 14.8 | 58.5 | 5 | 78 |
| WG77 (XPH12-9) | H1000 | 233 | 242 | 12.2 | 43.7 | 9 | 65 |
| WD31 (C455) | H1000 | 210 | 221 | 15.7 | 57.1 | 6.5 | 75 |
| WG78 (C465) | H1000* | 208 | 228 | 17.5 | 63.0 | 24 | 108 |

*Cryogenic treatment in liquid nitrogen for 4 hrs after solution treatment.

Example 2

Several 300-lb heats of steel alloys of the present invention were formed, tested, and compared to representative samples of commercially available and/or known steel alloys. The chemistries of the 300-lb heats that were formed and tested are shown in Table 4. One heat, identified as WK48, is a representative sample of C465, discussed above. A second heat, identified as WK50, has constituents and concentrations that fall within the broad range disclosed in U.S. Pat. No. 5,512,237 to Stigenberg. This patent suggests the use of all three strengthening elements Ti, Al and Cu, but with relatively high amounts of Ti and low amounts of Al in contrast to relatively high amounts of Al and low amounts of Ti, as set forth in embodiments of the present this invention. The commercial alloy 1RK91 developed from this patent is distinct from steels in the present invention and is mainly used for tooling applications. Each of heats WK48 and WK50 (1RK91 derivative) were formed, tested, and compared to embodiments of steel alloys of the present invention (identified in Tables 4-8 as Heats 4-13). No heats were made for the other representative samples of commercial ultra-high strength stainless steels discussed previously because the properties exhibited by these representative samples were significantly inferior to steels of the present invention and were not expected to differ from the results obtained from the 50-lb heats discussed above.

Figure 3:
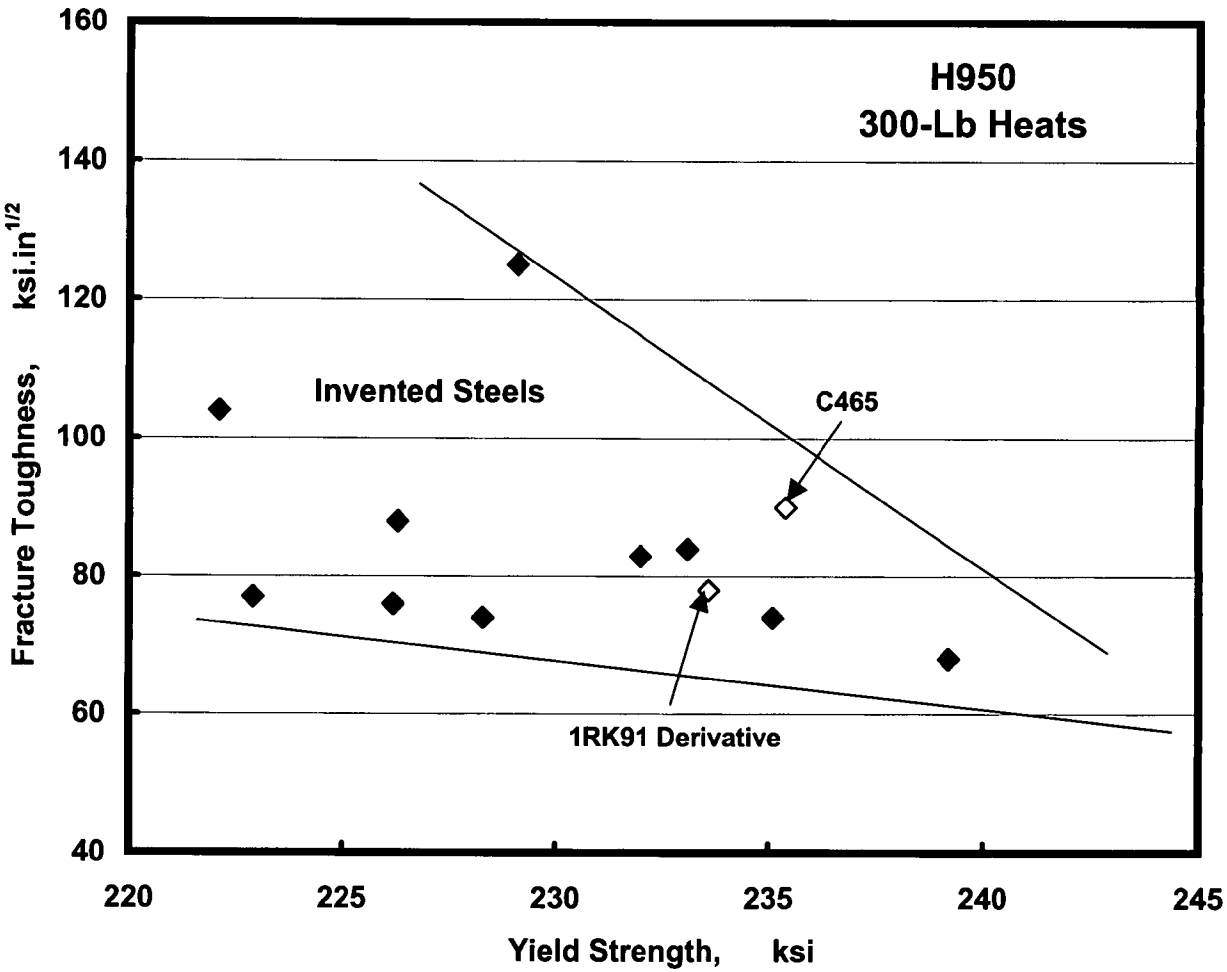
FIG. 3 graphically illustrates fracture toughness in certain steels produced in 300-lb heats as a function of yield strength at H950 condition.
Figure 4:
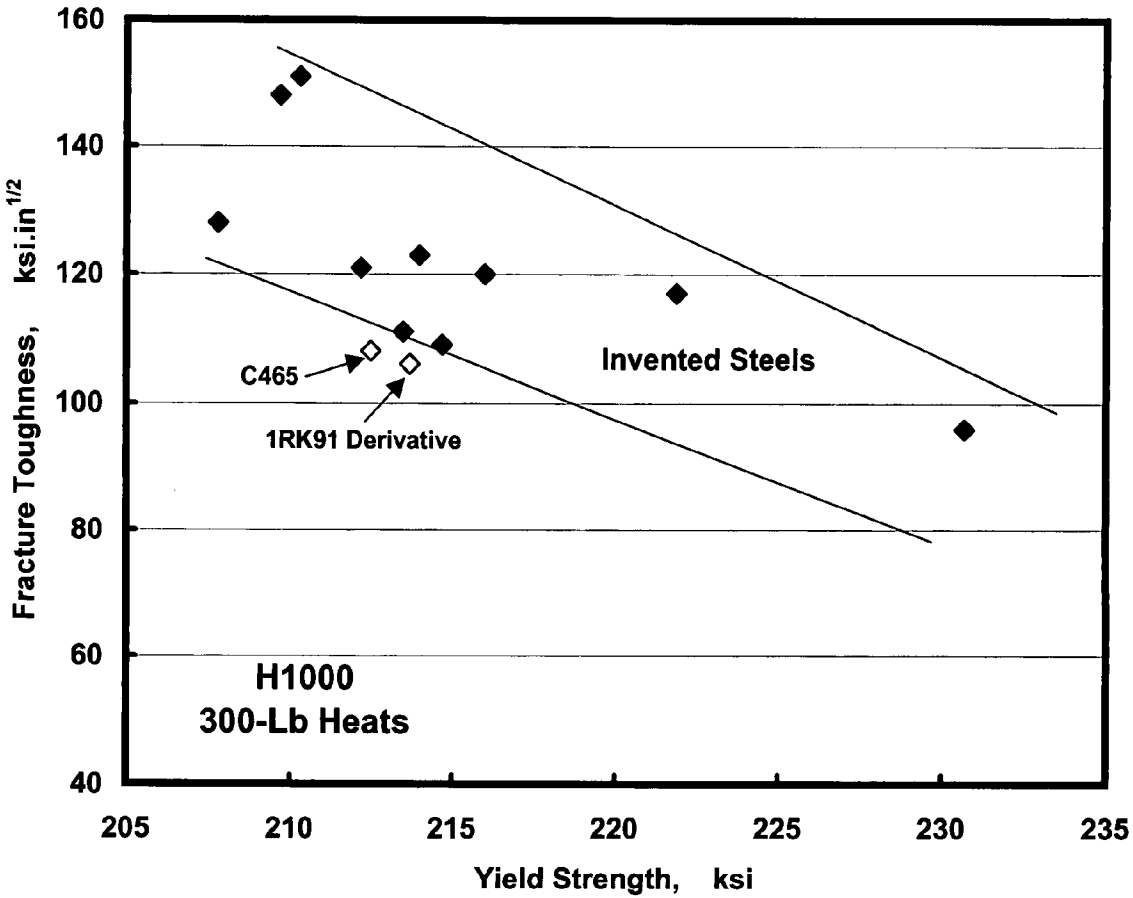
FIG. 4 graphically illustrates fracture toughness in certain steels produced in 300-lb heats as a function of yield strength at H1000 condition.
Figure 5:
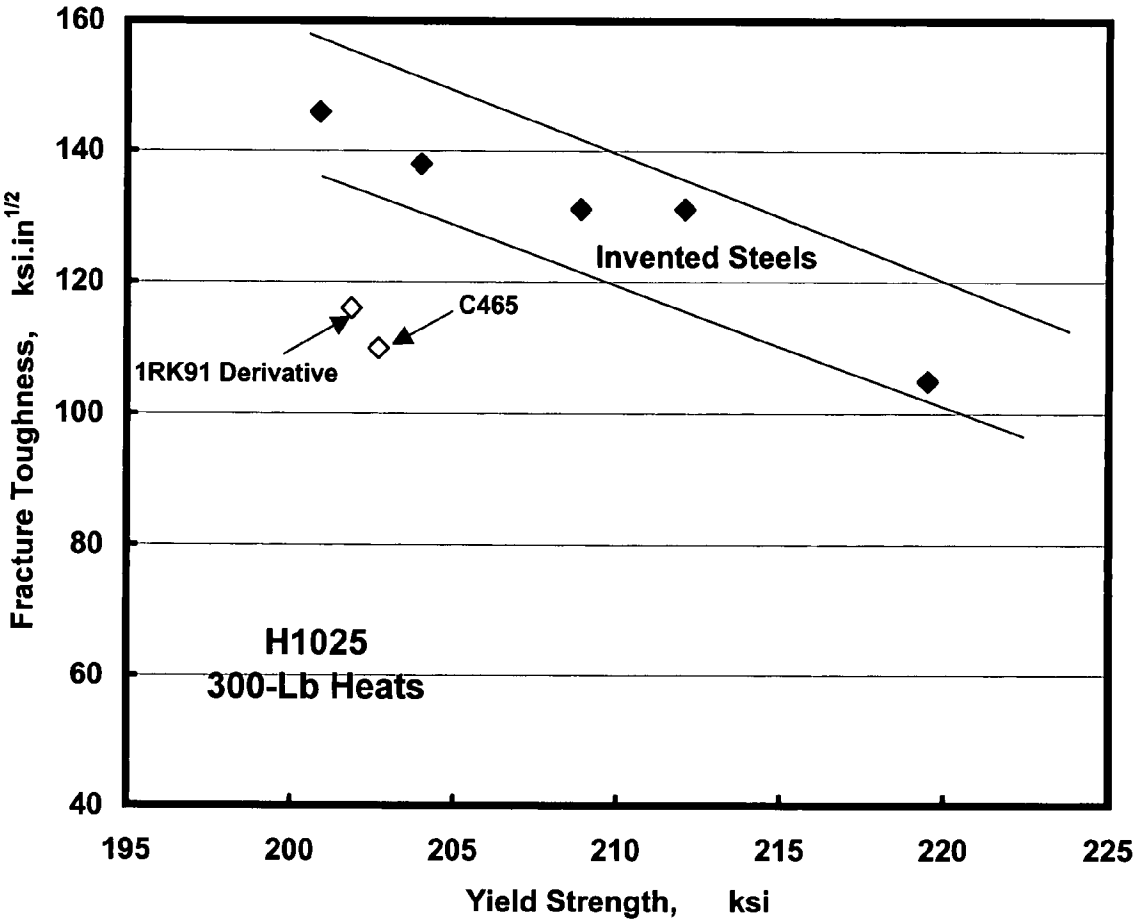
FIG. 5 graphically illustrates fracture toughness in certain steels produced in 300-lb heats as a function of yield strength at H1025 condition.

The comparative testing included forging 8 inch round VAR ingots of test steels into 3×3 inch billets at 1900° F. The billets were rolled to 1×3 inch plates at 1850° F. Mechanical test blanks were cut from rolled plates and heat-treated in the same manner as in the blanks for the 50-lb heats in Example 1, described above. The blanks were tested for tensile strength, Charpy impact, and fracture toughness, the data for which is reported in Table 5. Those results are also plotted in FIG. 3 for H950, FIG. 4 for H1000, and FIG. 5 for H1025 conditions.

As illustrated in the tables and figures, and similar to those results reported for the 50-lb heats of test alloys, discussed above, embodiments of the steel alloys of the present invention have strength and toughness at least equal to and in most cases superior to representative samples of the C465 alloy (WK48) and the WK50 alloy at various aging conditions.

Important differences exist between embodiments of the steel alloys of the present invention and the existing steels C465 and/or WK50. With respect to the C465 steel alloys, the process of forming the C465 alloys includes a cryogenic treatment following solution treatment. In contrast and as discussed above, cryogenic treatment is not necessary in forming the steel alloys of the present invention. Rather, all mechanical characteristics of the steel alloys of the present invention, as shown in Table 5, were obtained using only a solution plus aging treatment. For comparative purposes, cryogenic treatment was performed on embodiments of the steel alloys of the present invention to determine if cryogenic treatment would improve the properties of the steels of the present invention. Table 6 illustrates the mechanical properties of embodiments of the steel alloys of the present invention obtained with and without cryogenic treatment in liquid nitrogen (−196° C.) for 4 hours after solution. Test results indicate that the differences in properties between embodiments of the present invention that were formed with and without cryogenic treatment is insignificant.

Another distinction noted between embodiments of the steel alloys of the present inventions and the C465 and WK58 steel alloys is that steels of the present invention have a favorable response to a broader ranges of aging temperatures. As Table 5 and FIGS. 1-5 illustrate, existing and newly invented steel alloys have comparable strength/toughness relationships in the H900-H950 aged conditions, but alloys of this invention are clearly superior in this regard in the H1000 and H1025 aged conditions. This indicates that, for a fixed strength-toughness requirement, higher aging temperatures could be employed in embodiments of the present invention, which are known to provide beneficial properties to the steel alloy, such as corrosion and SCC resistance.

Fatigue and stress corrosion cracking resistances of steel alloys of the present invention were evaluated, and the results are shown in Table 7. Fatigue strength was determined by a rotating bend test and 1000-hr conditional $K_{1SCC}$ by self-loaded compact specimens in 3.5% NaCl aqueous solution at room temperature. Test results indicated that there is no significant difference in fatigue strength among the various tested embodiments of the steel alloys of the present invention. Although not intending to be bound by any theory, this may have occurred because fatigue strength is, generally, determined by the yield strength exhibited by the steel alloys, and the measured yield strength of the steel alloys of the present invention are closely related.

It was also found that embodiments of the steel alloys of the present invention exhibited improved SCC resistance compared to existing commercial alloys. Table 7 shows SCC test results with an initial K1 equivalent to 90% of the fracture toughness for two different heat treat conditions. All of the invented alloys in the H1000 condition and all but one in the H950 condition survived 1000 hours exposure with no cracking, while neither of the existing commercial alloys did. In contrast, the representative samples of the C465 (WK48) and WK50 steel alloys either cracked or broke during testing. Although not intending to be bound by any theory, it is believed that SCC resistance is reduced with increasing titanium content, indicating that while Ti as a strengthening element in these steels may improve strength and fracture toughness, it may adversely affect SCC resistance.

The resistance to localized corrosion (pitting and crevice corrosion) for embodiments of the steel alloys of the present invention was evaluated by potentiodynamic polarization measurement per ASTM 61. The results are listed in Table 8. Generally speaking, the higher the potential for localized corrosion (expressed in mv), the higher the resistance to localized corrosion such as pitting and crevice corrosion. As illustrated, steel alloys of the present invention, such as, for example, tungsten-containing steels, showed relatively high resistance to localized corrosion, and the greatest potential for improved results relating to localized corrosion. The tungsten-containing steels of the present invention also exhibited no pitting after testing. In contrast, the representative sample of C465 exhibited severe pitting after testing. Referring to the behavior of test steels in the SCC test, it appears that the addition of tungsten, and possibly boron, improves both SCC and localized corrosion resistances.

TABLE 4

Chemistry of 300-Lb Heats of Test Alloys

| | CHEMISTRY (wt. %) | | | | | | | | | | | | | | | |
|---|---|---|---|---|---|---|---|---|---|---|---|---|---|---|---|---|
| Heat No. | C | Ni | Cr | Co | Mo | W | Nb | Ti | Al | Cu | Mn | Si | S | P | B | N |
| 4 | 0.013 | 9.30 | 11.35 | 0.01 | 1.52 | <.05 | 0.02 | 0.17 | 1.12 | 1.96 | <0.01 | <0.01 | <.0003 | 0.004 | <.0005 | 0.0004 |
| 5 | 0.012 | 9.59 | 11.65 | 0.01 | 1.97 | 0.02 | 0.02 | 0.21 | 1.12 | 1.95 | <0.01 | <0.01 | 0.0004 | 0.004 | <.0005 | 0.0007 |
| 6 | 0.013 | 9.56 | 11.65 | 0.01 | 1.96 | 1.00 | 0.02 | 0.21 | 1.11 | 1.97 | <0.01 | <0.01 | 0.0003 | 0.003 | <.0005 | 0.0006 |
| 7 | 0.013 | 9.47 | 11.68 | 0.01 | 1.99 | 0.99 | 0.02 | 0.25 | 1.11 | 1.50 | <0.01 | <0.01 | 0.0003 | 0.003 | <.0005 | 0.0006 |
| 8 | 0.010 | 10.01 | 11.45 | 0.01 | 2.01 | <.05 | 0.02 | 0.30 | 1.16 | 0.93 | <0.01 | <0.01 | <.0003 | 0.003 | <.0005 | 0.0007 |
| 9 | 0.013 | 9.26 | 11.55 | 0.01 | 1.51 | <.05 | 0.01 | 0.30 | 1.17 | 2.00 | <0.01 | <0.01 | <.0003 | 0.004 | <.0005 | 0.0006 |
| 10 | 0.013 | 10.02 | 11.77 | 0.01 | 1.51 | 1.00 | 0.02 | 0.32 | 1.24 | 1.00 | <0.01 | <0.01 | <.0003 | <0.003 | 0.0010 | 0.0010 |
| 11 | 0.012 | 10.02 | 11.56 | 0.01 | 1.49 | <.05 | 0.02 | 0.42 | 1.19 | 1.00 | <0.01 | <0.01 | 0.0006 | 0.005 | <.0005 | 0.0006 |
| 12 | 0.014 | 10.07 | 11.74 | 0.01 | 1.50 | <.05 | 0.02 | 0.45 | 1.17 | 1.00 | <0.01 | <0.01 | 0.0005 | <0.003 | <.0005 | 0.0003 |
| 13 | 0.013 | 10.33 | 11.39 | 0.01 | 1.43 | 0.90 | 0.01 | 0.42 | 0.93 | 0.89 | <0.01 | <0.01 | 0.0004 | <0.003 | <.0005 | 0.0004 |
| WK50 (1RK91 derivative) | 0.013 | 9.96 | 11.53 | 0.01 | 1.52 | <.01 | 0.02 | 1.09 | 0.35 | 1.00 | <0.01 | <0.01 | 0.0006 | 0.004 | <.0005 | 0.0006 |
| WK48 (C465) | 0.006 | 10.96 | 11.48 | 0.07 | 1.00 | <.05 | <0.01 | 1.60 | 0.03 | <0.01 | <0.01 | <0.01 | 0.0006 | <0.003 | <.0005 | 0.0006 |

TABLE 5

Mechanical Properties of 300-Lb Heats of Embodiments of the Present Invention (1700° F. × 4 hrs solution and aged 4 hrs at designated temperatures (° F.))

| | Heat | Tensile Properties | | | | Charpy Impact | |
|---|---|---|---|---|---|---|---|
| Heat No. | Treatment | UTS ksi | YS ksi | EL % | RA % | Energy ft-lbs. | $K_{1J}$ ksi · in$^{1/2}$ |
| 4 | H900 | 241.7 | 226.1 | 13.8 | 48.3 | 10 | |
| | H925 | 238.9 | 226.9 | 13.6 | 49.4 | 23 | 87 |
| | H950 | 235.0 | 222.1 | 14.7 | 53.4 | 27 | 104 |
| | H975 | 225.1 | 217.7 | 16.3 | 61.7 | 37 | / |
| | H1000 | 218.5 | 209.7 | 16.1 | 64.5 | 39 | 148 |
| | H1025 | 202.1 | 194.3 | 18.2 | 68.9 | 79 | / |
| | H1050 | 188.2 | 178.6 | 19.9 | 72.8 | 98 | / |
| 5 | H900 | 244.3 | 233.8 | 13.4 | 42.8 | 13 | / |
| | H950 | 239.0 | 227.9 | 14.3 | 51.0 | 19 | 88 |
| | H975 | 231.5 | 220.4 | 15.4 | 55.7 | 27 | 118 |
| | H1000 | 224.8 | 213.1 | 15.9 | 61.3 | 40 | 121 |
| | H1025 | 210.5 | 200.9 | 16.8 | 65.7 | 71 | 146 |
| | H1050 | 193.6 | 186.0 | 18.8 | 67.4 | 106 | / |
| 6 | H900 | 239.7 | 224.8 | 12.7 | 42.0 | 11 | / |
| | H950 | 236.7 | 222.9 | 13.6 | 47.7 | 16 | 77 |
| | H975 | 226.8 | 215.2 | 15.3 | 53.9 | 22 | 91 |
| | H1000 | 223.8 | 214.0 | 16.1 | 60.1 | 32 | 123 |
| | H1025 | 204.7 | 197.0 | 17.5 | 65.5 | 57 | 137 |
| | H1050 | 190.3 | 182.9 | 20.0 | 70.0 | 98 | / |
| 7 | H900 | 245.3 | 227.4 | 12.5 | 40.7 | 7 | / |
| | H950 | 241.7 | 228.3 | 13.7 | 49.4 | 18 | 74 |
| | H975 | 239.7 | 223.5 | 14.5 | 53.5 | 24 | 88 |
| | H1000 | 227.1 | 214.7 | 15.7 | 56.5 | 33 | 109 |
| | H1025 | 219.1 | 208.9 | 18.2 | 63.7 | 53 | 131 |
| | H1050 | 202.5 | 195.4 | 18.5 | 67.6 | 83 | / |
| 8 | H900 | 239.6 | 224.8 | 14.0 | 43.6 | 8. | / |
| | H925 | 240.5 | 225.0 | 13.3 | 43.9 | 9 | / |

TABLE 5-continued

Mechanical Properties of 300-Lb Heats of Embodiments of the Present Invention (1700° F. × 4 hrs solution and aged 4 hrs at designated temperatures (° F.))

| Heat No. | Heat Treatment | Tensile Properties UTS ksi | YS ksi | EL % | RA % | Charpy Impact Energy ft-lbs. | $K_{1J}$ ksi · in$^{1/2}$ |
|---|---|---|---|---|---|---|---|
| | H950 | 241.3 | 226.2 | 14.2 | 49.9 | 13 | 76 |
| | H975 | 229.0 | 217.6 | 15.3 | 58.2 | 25 | / |
| | H1000 | 223.6 | 213.5 | 15.7 | 60.0 | 35 | 111 |
| | H1025 | 207.0 | 198.0 | 17.9 | 68.1 | 62 | / |
| | H1050 | 197.4 | 187.5 | 19.2 | 72.0 | 95 | / |
| 9 | H900 | 250.2 | 235.2 | 14.9 | 47.6 | 11 | / |
| | H950 | 247.1 | 231.6 | 15.0 | 54.9 | 24 | 83 |
| | H975 | 238.4 | 227.9 | 15.0 | 58.7 | 29 | / |
| | H1000 | 223.5 | 216.8 | 15.1 | 61.1 | 45 | 120 |
| | H1025 | 211.5 | 205.0 | 16.0 | 64.6 | 55 | 138 |
| | H1050 | 195.5 | 186.4 | 18.9 | 70.9 | 100 | / |
| 10 | H900 | 233.2 | 217.1 | 14.5 | 43.2 | 8 | / |
| | H925 | 236.6 | 220.4 | 14.0 | 46.4 | 14 | / |
| | H950 | 241.4 | 233.1 | 15.4 | 52.6 | 15 | 84 |
| | H975 | 227.2 | 215.6 | 15.8 | 55.5 | 16 | / |
| | H1000 | 218.1 | 207.8 | 17.1 | 61.0 | 23 | 125 |
| | H1025 | 204.1 | 197.9 | 19.1 | 67.0 | 37 | / |
| | H1050 | 184.7 | 173.9 | 22.4 | 70.7 | 69 | / |
| 11 | H900 | 247.1 | 233.1 | 13.6 | 45.2 | 9 | / |
| | H950 | 247.8 | 235.1 | 14.2 | 51.3 | 11 | 74 |
| | H975 | 240.5 | 230.3 | 14.3 | 54.6 | 13 | 85 |
| | H1000 | 234.2 | 221.9 | 15.2 | 60.4 | 22 | 117 |
| | H1025 | 219.3 | 212.1 | 16.3 | 65.6 | 38 | 131 |
| | H1050 | 196.5 | 188.7 | 18.8 | 70.7 | 86 | / |
| 12 | H900 | 255.4 | 236.3 | 11.2 | 35.4 | 6 | / |
| | H950 | 253.8 | 239.2 | 12.8 | 44.0 | 7 | 68 |
| | H975 | 250.5 | 241.2 | 12.2 | 47.1 | 12 | 78 |
| | H1000 | 240.2 | 230.7 | 14.1 | 54.7 | 14 | 96 |
| | H1025 | 230.7 | 219.5 | 15.2 | 57.7 | 23 | 105 |
| | H1050 | 210.0 | 198.9 | 17.9 | 64.5 | 35 | / |
| 13 | H925 | 240.8 | 228.3 | 13.6 | 51.2 | 28 | / |
| | H950 | 241.1 | 229.1 | 14.9 | 57.8 | 35 | 125 |
| | H975 | 235.9 | 226.9 | 15.8 | 59.4 | 42 | 137 |
| | H1000 | 218.4 | 210.3 | 17.7 | 63.9 | 67 | 151 |
| | H1025 | 201.2 | 192.6 | 18.1 | 68.3 | 78 | 174 |
| | H1050 | 189.4 | 177.5 | 21.5 | 71.9 | 121 | / |
| WK50 | H900 | 255.0 | 241.2 | 13.8 | 51.3 | 11 | / |
| | H925 | 256.8 | 240.1 | 14.0 | 52.5 | 14 | 77 |
| | H950 | 249.4 | 233.6 | 14.7 | 54.5 | 14 | 78 |
| | H975 | 236.7 | 225.6 | 16.0 | 58.3 | 21 | / |
| | H1000 | 223.9 | 213.7 | 17.4 | 61.3 | 26 | 109 |
| | H1025 | 212.5 | 201.8 | 19.5 | 63.0 | 32 | 116 |
| | H1050 | 205.7 | 191.7 | 20.8 | 64.3 | 37 | / |
| WK48 | H900* | 255.0 | 233.0 | 15.4 | 50.5 | 8 | / |
| (C465) | H925* | 255.1 | 242.6 | 16.6 | 56.4 | 14 | 69 |
| | H950* | 250.9 | 235.4 | 16.7 | 58.7 | 18 | 90 |
| | H975* | 243.2 | 223.3 | 17.3 | 61.7 | 19 | / |
| | H1000* | 228.4 | 212.5 | 19.3 | 64.4 | 27 | 108 |
| | H1025* | 212.8 | 202.7 | 20.4 | 64.8 | 37 | 110 |
| | H1050* | 206.3 | 193.5 | 20.6 | 65.1 | 40 | / |

"/" Signifies no measurement taken

*Cryogenic treatment at −320° F. for 4 hr minimum immediately after solution treatment.

TABLE 6

Effect of Cryogenic Treatment on Mechanical Properties of Test Steels

| Heat No. | Heat Treatment | Tensile Properties UTS ksi | YS ksi | EL % | RA % | Charpy Impact ft-lbs. | $K_{1J}$ ksi · in$^{1/2}$ |
|---|---|---|---|---|---|---|---|
| 8 | H950 | 241.3 | 226.2 | 14.2 | 49.9 | 13.0 | 76 |
| | H950* | 234.4 | 221.9 | 14.4 | 53.0 | 21.5 | / |

TABLE 6-continued

Effect of Cryogenic Treatment on Mechanical Properties of Test Steels

| Heat No. | Heat Treatment | Tensile Properties UTS ksi | YS ksi | EL % | RA % | Charpy Impact ft-lbs. | $K_{1J}$ ksi · in$^{1/2}$ |
|---|---|---|---|---|---|---|---|
| | H1000 | 223.6 | 213.5 | 15.7 | 60.0 | 35.0 | 111 |
| | H1000* | 218.0 | 208.5 | 16.8 | 61.1 | 35.5 | / |
| 9 | H950 | 247.1 | 231.6 | 15.0 | 54.9 | 24.0 | 83 |
| | H950* | 241.3 | 228.8 | 15.1 | 56.4 | 23.0 | 84 |
| | H1000 | 223.5 | 216.8 | 15.1 | 61.1 | 45.0 | 120 |
| | H1000* | 224.9 | 214.2 | 17.2 | 64.3 | 47.0 | 127 |
| 10 | H950 | 241.4 | 233.1 | 15.4 | 52.6 | 15.0 | 84 |
| | H950* | 242.1 | 228.8 | 13.5 | 50.5 | 23.0 | 90 |
| | H1000 | 218.1 | 207.8 | 17.1 | 61.0 | 23.0 | 125 |
| | H1000* | 219.4 | 208.7 | 16.5 | 61.1 | 44.0 | 126 |
| 11 | H950 | 247.8 | 235.1 | 14.2 | 51.3 | 11.0 | 74 |
| | H950* | 247.7 | 234.7 | 13.7 | 52.1 | 8.5 | / |
| | H1000 | 234.2 | 221.9 | 15.2 | 60.4 | 22.0 | 117 |
| | H1000* | 229.7 | 220.4 | 15.9 | 60.5 | 23.5 | / |

"/" Signifies no measurement taken.

*Cryogenic treatment in liquid nitrogen for 4 hrs after solution treatment.

TABLE 7

Fatigue and Stress Corrosion Cracking Properties of Selected Test Alloys (1700° F. × 4 hrs solution and aged 4 hrs at designated temperatures (° F.))

| Heat No. | Heat Treatment. | Fatigue Strength at $10^7$ ksi | SCC Test Initial $K_I$, ksi · in$^{1/2}$ | Unload $K_I$, ksi · in$^{1/2}$ | Crack Growth at 1000 hrs |
|---|---|---|---|---|---|
| 7 | H950 | 102 | / | / | / |
| | H1000 | 100 | / | / | / |
| 8 | H950 | 90 | 72 | 62.3 | No |
| | H1000 | 95 | 108 | 82.4 | No |
| 9 | H950 | 100 | 72 | 61.2 | No |
| | H1000 | 102 | 90 | 76.6 | No |
| 10 | H950 | 100 | 72 | 62.1 | No |
| | H1000 | 98 | 90 | 75.7 | No |
| 11 | H950 | 105 | 72 | / | Broken at 576 hrs |
| | H1000 | 100 | 90 | 76.1 | No |
| WK50 | H950 | / | 60 | 53.1 | Yes (Δa = 0.15 mm) |
| | H1000 | / | 70 | 50.4 | Yes (Δa = 0.17 mm) |
| WK48 | H950* | 104 | 81 | / | Broken at 576 hrs |
| | H1000* | 100 | 90 | / | Broken at 576 hrs |

"/" Signifies no measurement taken.

*Cryogenic treatment at −320° F. for 4 hrs after solution treatment.

TABLE 8

ASTM G61 Test Results of High Strength Stainless Steels

| Heat No. | Heat Treatment | $E_{corr}$ Mv | Potential for Localized Corrosion, mv Initial | Permanent | Localized Corrosion Observed |
|---|---|---|---|---|---|
| 7 | H950 | −189 | 457 | 464 | 0 pit |
| | H1000 | −520 | 438 | / | 0 pit |
| 9 | H950 | −372 | 278 | / | 0 pit |
| | H1000 | −520 | 390 | / | 6 pits |
| 11 | H1000 | −387 | 242 | / | 0 pit |
| | H1025 | −185 | 387 | / | 2 pits |
| 12 | H1000 | −435 | 337 | / | 0 pit |
| | H1025 | −313 | 228 | 287 | 20 pits |
| WK48 | H950* | −666 | 392 | 407 | 6 pits |
| (C465) | H1000* | −808 | 315 | / | Pits over |

TABLE 8-continued

ASTM G61 Test Results of High Strength Stainless Steels

| Heat No. | Heat Treatment | $E_{corr}$ Mv | Potential for Localized Corrosion, mv Initial | Permanent | Localized Corrosion Observed |
|---|---|---|---|---|---|
| | | | | | 40% surface |

"/" Signifies no measurement taken.

*Cryogenic treatment at −320° F. for 4 hrs after solution treatment.

Embodiments of the steel alloys of the present invention provide a combination of excellent performance properties such as strength, toughness, fatigue, and corrosion/SCC resistance within a wide range of aging temperatures. These properties are obtained by processing martensitic stainless steel alloys with a simple solution-aging treatment, without the need for cryogenic treatment after solution. At the test conditions provided, embodiments of stainless steel alloys of the present invention exhibit high strength-toughness levels that are superior to other commercially available prior art stainless steels. These strength properties are achievable after processing at high aging temperature, such as at 1000° F. or above, to provide excellent ductility, toughness, and corrosion/SCC properties, and provide resistance to steel failure. Furthermore, embodiments of steel alloys of the present invention exhibit increased grain boundary cohesion due to W and/or B additions and provide high corrosion and SCC resistance.

It will be appreciated by those of ordinary skill in the art that the present invention provides certain test parameters, conditions, and characteristics relative to specific alloying elements to achieve high strength properties and to improve the characteristics of martensitic stainless steel alloys. These parameters, conditions, and characteristics provide an approach to improve properties, such as the strength and toughness, of certain martensitic stainless steels and to provide improved integrity and performance in the articles formed therefrom. It will also be appreciated by those skilled in the art that changes could be made to the embodiments described herein without departing from the broad concept of the invention. It is understood, therefore, that this invention is not limited to the particular embodiments disclosed, but is intended to cover modifications that are within the spirit and scope of the invention, as defined by the appended claims.

I claim:

1. A precipitation-hardenable martensitic stainless steel comprising, in percent by weight:

11.0% to 12.5% chromium;
1.0% to 2.5% molybdenum;
0.15% to 0.5% titanium;
0.7% to 1.5% aluminum;
0.5% to 2.5% copper;
9.0% to 11.0% nickel;
up to 0.02% carbon;
0. 5% to 1.5% tungsten; and
up to 0.001% boron;
wherein iron and incidental impurities are substantially the remainder of the total content, and wherein the stainless steel has a yield strength of at least 230 ksi, $K_{IC}$ of at least 70 ksi·in$^{1/2}$, and $K_{ISCC}$ of at least 50 ksi·in$^{1/2}$.

2. The stainless steel of claim 1, wherein the amount of chromium ranges from 11.0% to 12.0% by weight.

3. The stainless steel of claim 1, wherein the amount of molybdenum ranges from 1.0% to 2.0% by weight.

4. The stainless steel of claim 1, wherein the amount of titanium ranges from 0.15% to 0.3% by weight.

5. The stainless steel of claim 1, wherein the amount of titanium ranges from 0.3% to 0.5% by weight.

6. The stainless steel of claim 1, wherein the amount of aluminum ranges from 1.0% to 1.3% by weight.

7. The stainless steel of claim 1, wherein the amount of aluminum ranges from 0.9% to 1.2% by weight.

8. The stainless steel of claim 1, wherein the amount of copper ranges from 1.5% to 2.5% by weight.

9. The stainless steel of claim 1, wherein the amount of copper ranges from 0.5% to 1.5% by weight.

10. The stainless steel of claim 1, wherein the amount of nickel ranges from 9.5% to 10% by weight.

11. The stainless steel of claim 1, wherein the amount of nickel ranges from 9.5% to 10.5% by weight.

12. The stainless steel of claim 1, wherein the amount of carbon ranges from 0.006% to 0.016% by weight.

13. The stainless steel of claim 1, wherein the amount of carbon ranges from 0.008% to 0.012% by weight.

14. The stainless steel of claim 1, wherein the amount of carbon ranges from 0.01% to 0.016% by weight.

15. The stainless steel of claim 1, wherein:

$$194.4+20.9\ (\%\ Al)+22.7(\%\ Ti)+6.8(\%\ Cu)>220.$$

16. The stainless steel of claim 1, wherein:

$$1200(\%\ C-0.006)+23(\%\ Cr-12)+40(\%\ Ni-9)+16(\%\ (Mo+1/2W)-1.5)+3.75(\%\ Al)+34(\%\ Ti)+20(\%\ Cu)\leqq 100.$$

17. A precipitation-hardenable martensitic stainless steel consisting essentially of, in percent by weight:

11.0% to 12.5% chromium;
1% to 2.5% molybdenum;
0.15% to 0.5% titanium;
0.7% to 1.5% aluminum;
0.5% to 2.5% copper;
9.0% to 11.0% nickel;
up to 0.02% carbon;
0.5% to 1.5% tungsten; and
up to 0.001% boron;
wherein iron and incidental impurities are substantially the remainder of the total content, and wherein the stainless steel has a yield strength of at least 230 ksi, $K_{IC}$ of at least 70 ksi·in$^{1/2}$, and $K_{ISCC}$ of at least 50 ksi·in$^{1/2}$.

18. The stainless steel of claim 17, wherein the amount of chromium ranges from 11.0% to 12.0% by weight.

19. The stainless steel of claim 17, wherein the amount of molybdenum ranges from 1.0% to 2.0% by weight.

20. The stainless steel of claim 17, wherein the amount of titanium ranges from 0.15% to 0.3% by weight.

21. The stainless steel of claim 17, wherein the amount of titanium ranges from 0.3% to 0.5% by weight.

22. The stainless steel of claim 17, wherein the amount of aluminum ranges from 1.0% to 1.3% by weight.

23. The stainless steel of claim 17, wherein the amount of aluminum ranges from 0.9% to 1.2% by weight.

24. The stainless steel of claim 17, wherein the amount of copper ranges from 1.5% to 2.5% by weight.

25. The stainless steel of claim 17, wherein the amount of copper ranges from 0.5% to 1.5% by weight.

26. The stainless steel of claim 17, wherein the amount of nickel ranges from 9.5% to 10% by weight.

27. The stainless steel of claim 17, wherein the amount of nickel ranges from 9.5% to 10.5% by weight.

28. The stainless steel of claim 17, wherein the amount of carbon ranges from 0.006% to 0.016% by weight.

29. The stainless steel of claim 17, wherein the amount of carbon ranges from 0.008% to 0.012% by weight.

30. The stainless steel of claim 17, wherein the amount of carbon ranges from 0.01% to 0.016% by weight.

31. The stainless steel of claim 17, wherein:

$$194.4+20.9\ (\%\ Al)+22.7(\%\ Ti)+6.8(\%\ Cu)>220.$$

32. The stainless steel of claim 31, wherein:

$$1200(\%\ C-0.006)+23(\%\ Cr-12)+40(\%\ Ni-9)+16(\%\ (Mo+1/2W)-1.5)+3.75(\%\ Al)+34(\%\ Ti)+20(\%\ Cu)\leqq 100.$$

33. A precipitation-hardenable martensitic stainless steel comprising, in percent by weight:

11.0% to 12.0% chromium;
1.0% to 2.0% molybdenum;
0.15% to 0.3% titanium;
1.0% to 1.3% aluminum;
1.5% to 2.5% copper;
9.0% to 10.0% nickel;
0.008% to 0.012% carbon;
0.5% to 1.5% tungsten; and
up to 0.001% boron;

wherein iron and incidental impurities are substantially the remainder of the total content, and wherein the stainless steel has a yield strength of at least 230 ksi, $K_{IC}$ of at least 70 ksi·in$^{1/2}$, and $K_{ISCC}$ of at least 50 ksi·in$^{1/2}$.

34. The stainless steel of claim 33, wherein:

$$194.4+20.9\ (\%\ Al)+22.7(\%\ Ti)+6.8(\%\ Cu)>220.$$

35. The stainless steel of claim 34, wherein:

$$1200(\%\ C-0.006)+23(\%\ Cr-12)+40(\%\ Ni-9)+16(\%\ (Mo+1/2W)-1.5)+3.75(\%\ Al)+34(\%\ Ti)+20(\%\ Cu)\leqq 100.$$

36. A precipitation-hardenable martensitic stainless steel consisting essentially of, in percent by weight:

11.0% to 12.0% chromium;
1.0% to 2.0% molybdenum;
0.15% to 0.3% titanium;
1.0% to 1.3% aluminum;
1.5% to 2.5% copper;
9.0% to 10.0% nickel;
0.008% to 0.012% carbon;
0.5% to 1.5% tungsten; and
up to 0.001% boron;

wherein iron and incidental impurities are substantially the remainder of the total content, and wherein the stainless steel has a yield strength of at least 230 ksi, $K_{IC}$ of at least 70 ksi·in$^{1/2}$, and $K_{ISCC}$ of at least 50 ksi·in$^{1/2}$.

37. The stainless steel of claim 36, wherein:

$$194.4+20.9\ (\%\ Al)+22.7(\%\ Ti)+6.8(\%\ Cu)>220.$$

38. The stainless steel of claim 37, wherein:

$$1200(\%\ C-0.006)+23(\%\ Cr-12)+40(\%\ Ni-9)+16(\%\ (Mo+1/2W)-1.5)+3.75(\%\ Al)+34(\%\ Ti)+20(\%\ Cu)\leqq 100.$$

39. A precipitation-hardenable martensitic stainless steel stainless steel comprising, in percent by weight:

11.0% to 12.0% chromium;
1.0% to 2.0% molybdenum;
0.3% to 0.5% titanium;
0.9% to 1.2% aluminum;
0.5% to 1.5% copper;
9.5% to 10.5% nickel;
0.01% to 0.016% carbon;
0.5% to 1.5% tungsten; and
up to 0.001% boron;

wherein iron and incidental impurities are substantially the remainder of the total content, and wherein the stainless steel has a yield strength of at least 230 ksi, $K_{IC}$ of at least 70 ksi·in$^{1/2}$ and $K_{ISCC}$ of at least 50 ksi·in$^{1/2}$.

40. The stainless steel of claim 39, wherein:

$$194.4+20.9\ (\%\ Al)+22.7(\%\ Ti)+6.8(\%\ Cu)>220.$$

41. The stainless steel of claim 40, wherein:

$$1200(\%\ C-0.006)+23(\%\ Cr-12)+40(\%\ Ni-9)+16(\%\ (Mo+1/2W)-1.5)+3.75(\%\ Al)+34(\%\ Ti)+20(\%\ Cu)\leqq 100.$$

42. A precipitation-hardenable martensitic stainless steel consisting essentially of, in percent by weight:

11.0% to 12.0% chromium;
1.0% to 2.0% molybdenum;
0.3% to 0.5% titanium;
0.9% to 1.2% aluminum;
0.5% to 1.5% copper;
9.5% to 10.5% nickel;
0.01% to 0.016% carbon;
0.5% to 1.5% tungsten; and
up to 0.001% boron;

wherein iron and incidental impurities are substantially the remainder of the total content, and wherein the stainless steel has a yield strength of at least 230 ksi, $K_{IC}$ of at least 70 ksi·in$^{1/2}$ and $K_{ISCC}$ of at least 50 ksi·in$^{1/2}$.

43. The stainless steel of claim 42, wherein:

$$194.4+20.9\ (\%\ Al)+22.7(\%\ Ti)+6.8(\%\ Cu)>220.$$

44. The stainless steel of claim 43, wherein:

$$1200(\%\ C-0.006)+23(\%\ Cr-12)+40(\%\ Ni-9)+16(\%\ (Mo+1/2W)-1.5)+3.75(\%\ Al)+34(\%\ Ti)+20(\%\ Cu)\leqq 100.$$

45. An article of manufacture comprising a precipitation-hardenable martensitic stainless steel comprising, in percent by weight:

11.0% to 12.5% chromium;
1.0% to 2.5% molybdenum;
0.15% to 0.5% titanium;
0.7% to 1.5% aluminum;
0.5% to 2.5% copper;
9.0% to 11.0% nickel;
up to 0.02% carbon;
0.5% to 1.5% tungsten; and
up to 0.001% boron;

wherein iron and incidental impurities are substantially the remainder of the total content, and wherein the stainless steel has a yield strength of at least 230 ksi, $K_{IC}$ of at least 70 ksi·in$^{1/2}$, and $K_{ISCC}$ of at least 50 ksi·in$^{1/2}$.

46. The article of manufacture of claim 45, selected from the group consisting of flap tracks, actuators, engine mounts, landing gear hardware, handgun barrels, and vehicle parts.

47. An article of manufacture comprising a precipitation-hardenable martensitic stainless steel consisting essentially of, in percent by weight:

11.0% to 12.5% chromium;
1.0% to 2.5% molybdenum;
0.15% to 0.5% titanium;
0.7% to 1.5% aluminum;
0.5% to 2.5% copper;
9.0% to 11.0% nickel;
up to 0.02% carbon;
0.5% to 1.5% tungsten; and
up to 0.001% boron;

wherein iron and incidental impurities are substantially the remainder of the total content, and wherein the stainless steel has a yield strength of at least 230 ksi, $K_{IC}$ of at least 70 ksi·in$^{1/2}$, and $K_{ISCC}$ of at least 50 ksi·in$^{1/2}$.

48. An article of manufacture comprising a precipitation-hardenable martensitic stainless steel comprising, in percent by weight:

11.0% to 12.0% chromium;
1.0% to 2.0% molybdenum;
0.15% to 0.3% titanium;
1.0% to 1.3% aluminum;
1.5% to 2.5% copper;
9.0% to 10.0% nickel;
0.008% to 0.012% carbon;
0.5% to 1.5% tungsten; and
up to 0.001% boron;

wherein iron and incidental impurities are substantially the remainder of the total content, and wherein the stainless steel has a yield strength of at least 230 ksi, $K_{IC}$ of at least 70 ksi·in$^{1/2}$, and $K_{ISCC}$ of at least 50 ksi·in$^{1/2}$.

49. An article of manufacture comprising a precipitation-hardenable martensitic stainless steel comprising, in percent by weight:

11.0% to 12.0% chromium;
1.0% to 2.0% molybdenum;
0.3% to 0.5% titanium;
0.9% to 1.2% aluminum;
0.5% to 1.5% copper;
9.5% to 10.5% nickel;
0.01% to 0.016% carbon;
0.5% to 1.5% tungsten; and
up to 0.001% boron;

wherein iron and incidental impurities are substantially the remainder of the total content, and wherein the stainless steel has a yield strength of at least 230 ksi, $K_{IC}$ of at least 70 ksi·in$^{1/2}$ and $K_{ISCC}$ of at least 50 ksi·in$^{1/2}$.

50. A method of forming a precipitation-hardenable martensitic stainless steel, the method comprising preparing a heat including, in percent by weight:

11.0% to 12.5% chromium;
1.0% to 2.5% molybdenum;
0.15% to 0.5% titanium;
0.7% to 1.5% aluminum;
0.5% to 2.5% copper;
9.0% to 11.0% nickel;
up to 0.02% carbon;
0.5% to 1.5% tungsten;
up to 0.001% boron; and
balance of iron and incidental impurities; and processing the heat to form the precipitation-hardenable martensitic stainless steel, the stainless steel having a yield strength of at least 230 ksi, $K_{IC}$ of at least 70 ksi·in$^{1/2}$, and $K_{ISCC}$ of at least 50 ksi·in$^{1/2}$.

51. The method of claim 50, wherein the amount of chromium ranges from 11.0% to 12.0% by weight.

52. The method of claim 50, wherein the amount of molybdenum ranges from 1.0% to 2.0% by weight.

53. The method of claim 50, wherein the amount of titanium ranges from 0.15% to 0.3% by weight.

54. The method of claim 50, wherein the amount of titanium ranges from 0.3% to 0.5% by weight.

55. The method of claim 50, wherein the amount of aluminum ranges from 1.0% to 1.3% by weight.

56. The method of claim 50, wherein the amount of aluminum ranges from 0.9% to 1.2% by weight.

57. The method of claim 50, wherein the amount of copper ranges from 1.5% to 2.5% by weight.

58. The method of claim 50, wherein the amount of copper ranges from 0.5% to 1.5% by weight.

59. The method of claim 50, wherein the amount of nickel ranges from 9.0% to 10.0% by weight.

60. The method of claim 50, wherein the amount of nickel ranges from 9.5% to 10.5% by weight.

61. The method of claim 50, wherein the amount of carbon ranges from 0.006% to 0.016% by weight.

62. The method of claim 50, wherein the amount of carbon ranges from 0.008% to 0.012% by weight.

63. The method of claim 50, wherein the amount of carbon ranges from 0.01% to 0.016% by weight.

* * * * *